United States Patent [19]

Ryan

[11] Patent Number: 4,895,328

[45] Date of Patent: Jan. 23, 1990

[54] THERAPEUTIC DEVICE FOR SUFFERERS OF BACK PAIN

[76] Inventor: Terrance Ryan, Box 34, Macklin, Saskatchewan, Canada, S0L 2C0

[21] Appl. No.: 362,889

[22] Filed: Jun. 5, 1989

Related U.S. Application Data

[63] Continuation of Ser. No. 61,807, Jun. 15, 1987, abandoned.

[51] Int. Cl.[4] ..... A61H 1/02

[52] U.S. Cl. ..... 248/124; 248/298; 248/328; 128/75

[58] Field of Search ..... 248/122, 124, 125, 327, 248/328, 298; 5/81 R; 128/75

[56] References Cited

U.S. PATENT DOCUMENTS

| | | | |
|---|---|---|---|
| Re. 30,611 | 5/1981 | Wappler | 414/542 |
| 1,080,297 | 12/1913 | Pitts et al. | 128/75 X |
| 2,509,950 | 5/1950 | Zierke | 414/543 |
| 2,633,124 | 3/1953 | Yellin | 128/75 |
| 3,068,859 | 12/1962 | Treutelaar | 128/75 |
| 3,490,603 | 1/1970 | Willer | 248/172 |
| 3,568,226 | 3/1971 | Mater et al. | 5/81 R |
| 3,662,750 | 5/1972 | Jorgensen | 128/75 |
| 4,659,276 | 4/1987 | Billett | 414/543 |

FOREIGN PATENT DOCUMENTS

| | | | |
|---|---|---|---|
| 1910836 | 10/1969 | Fed. Rep. of Germany | 5/81 R |
| 3420858 | 12/1985 | Fed. Rep. of Germany | 128/75 |
| 660681 | 5/1979 | U.S.S.R. | 128/75 |

*Primary Examiner*—Alvin C. Chin-Shue

*Attorney, Agent, or Firm*—Simmons, Perrine, Albright & Ellwood

[57] ABSTRACT

A therapeutic device for persons suffering back pain from compression of the spinal column features a cradle used in conjunction with a chair or the like in which the sufferer is seated with his arms and elbows close to his or her sides. The cradle includes a pair of arms which lie along and beneath the person's forearms. A mechanism raised the cradle so that the weight of the body is at least partially lifted from the chair and transferred to the person's upper arms and shoulders, thus reducing compressive weight on the spinal column.

6 Claims, 3 Drawing Sheets

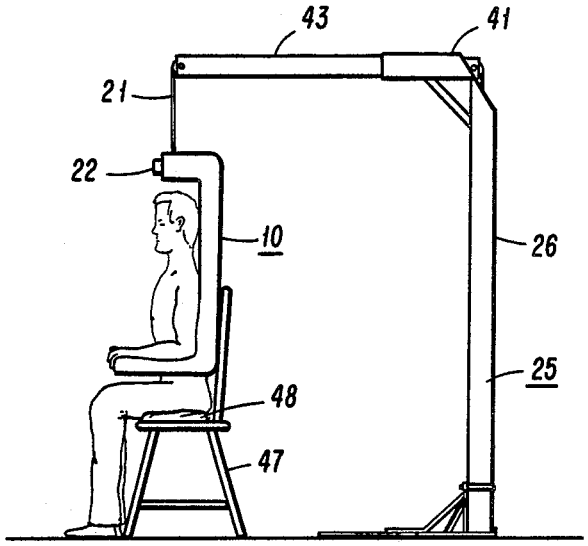
FIG 5
FIG 3
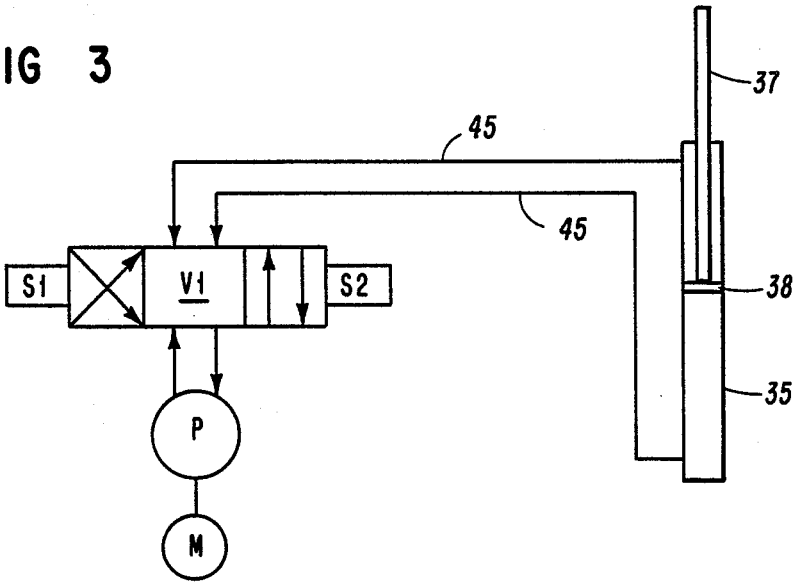
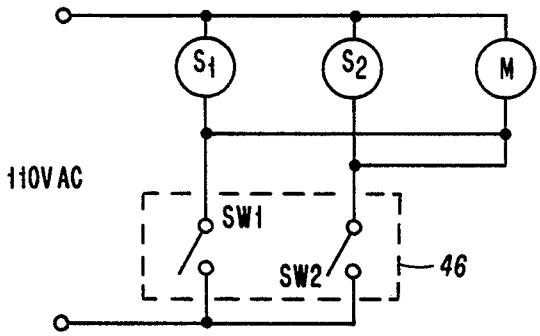
FIG 4

THERAPEUTIC DEVICE FOR SUFFERERS OF BACK PAIN

This is a continuation of co-pending application Ser. No. 07/061,807 filed on June 15, 1987 now abandoned.

BACKGROUND OF THE INVENTION

The back pain suffered by persons owing to or aggregated by compression of the spinal column is, as is well-known, at least partially alleviated by reducing that compression. Various types of traction devices are often used for that purpose which also in some cases hastens the healing process. Until the advent of the present invention there were, so far as known, only about four modes of traction employed to relieve spinal column compression: (1) The patient lies on a bed with pulley mounted weights attached to his ankles. (2) The patient is hung by his ankles on a machine which is essentially a bed rotated to a vertical position. (3) The patient is suspended by an underarm sling. (4) The patient wears a special belt which stretches the back through pressure exerted on the abdomen.

But each of these devices in turn causes its own discomfort. In the case of the first and second the patient is obviously rendered almost completely non-productive and insociable. The third can be sustained only for short periods because of pressure on the nerves and blood vessels through the armpit areas, impeding neural response and blood circulation. The fourth, the pressure belt, causes visceral discomfort and is known to hinder digestion.

So the principal objective of the invention is a therapeutic device for relieving pain caused by spinal column compression which avoids the discomforts and deficiencies of the other devices mentioned.

SUMMARY OF THE INVENTION

The object of the invention is achieved by a kind of "cradle" used in conjunction with a chair, preferably an armless one, or the like in which a person sits with his arms and elbows close to his sides. The cradle includes a pair of laterally spaced, padded arm members, which lie along and beneath the person's forearms, and an adjustable structure interconnecting the rear ends of the arm members. The cradle is attached in turn to a cradle elevating mechanism such that the height of the cradle can be adjusted up and down by controls operated by the seated person. The controls are manipulated to raise the cradle and thus lift the weight of the person's body at least partially off the chair, thus decompressing his spinal column since the cradle in effect supports the body by its upper arms and shoulders. The device has been found in practice to bring great relief to back sufferers who, once accustomed to the device, can remain suspended for many hours without discomfort yet be productive and sociable.

Other features and advantages of the invention will become apparent from the drawings and the more detailed description which follows:

BRIEF DESCRIPTION OF THE DRAWINGS

FIG. 3 is a schematic of the hydraulic circuitry used in the device of FIG. 1.

FIG. 4 is a schematic of the electrical circuitry used in the device of FIG. 1.

FIG. 5 is an elevational view of the device of FIG. 1 shown in use by a seated person

DETAILED DESCRIPTION OF THE PREFERRED EMBODIMENT

Figure 1:
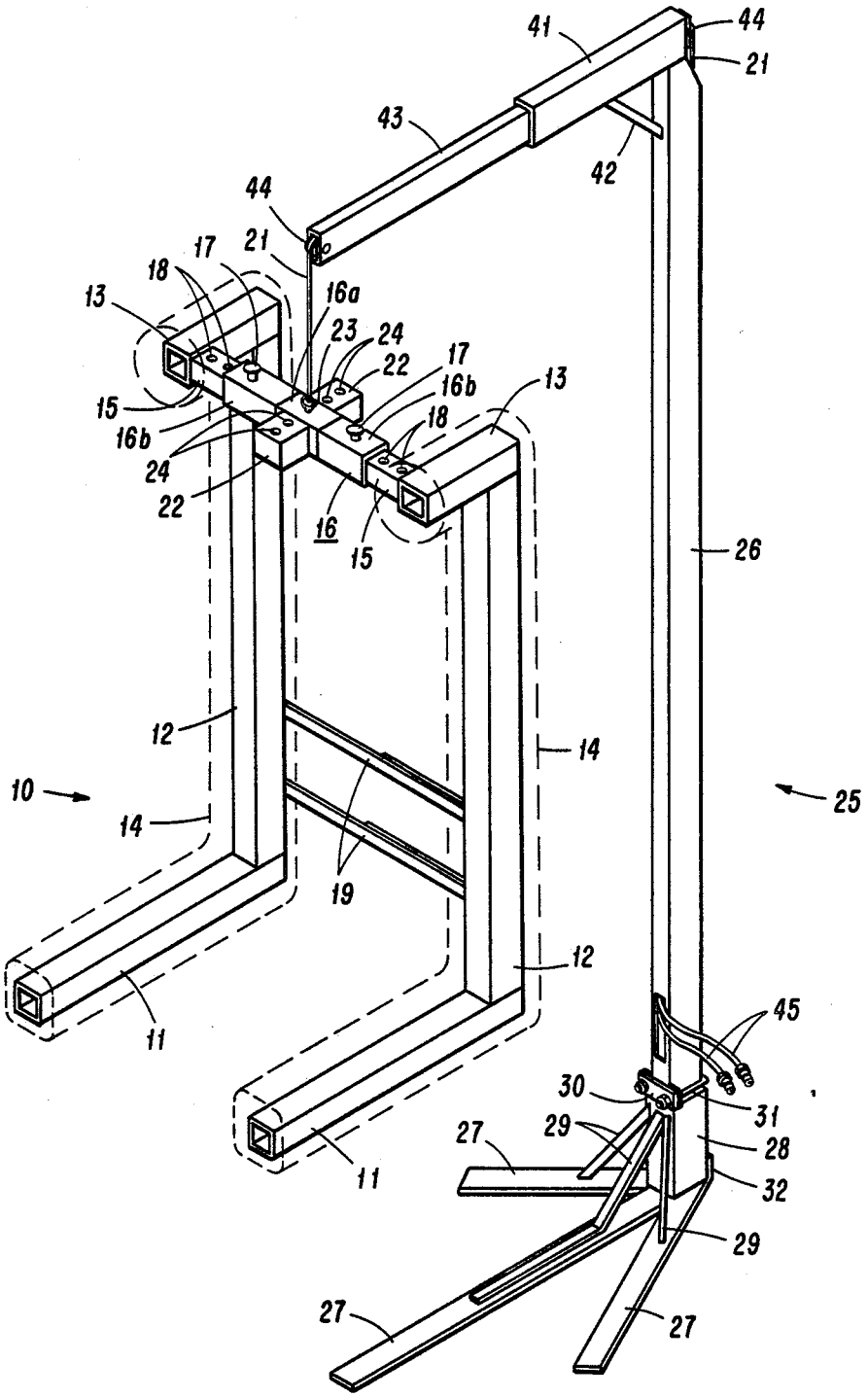
FIG. 1 is an isometric view of the therapeutic device of the invention.
Figure 2:
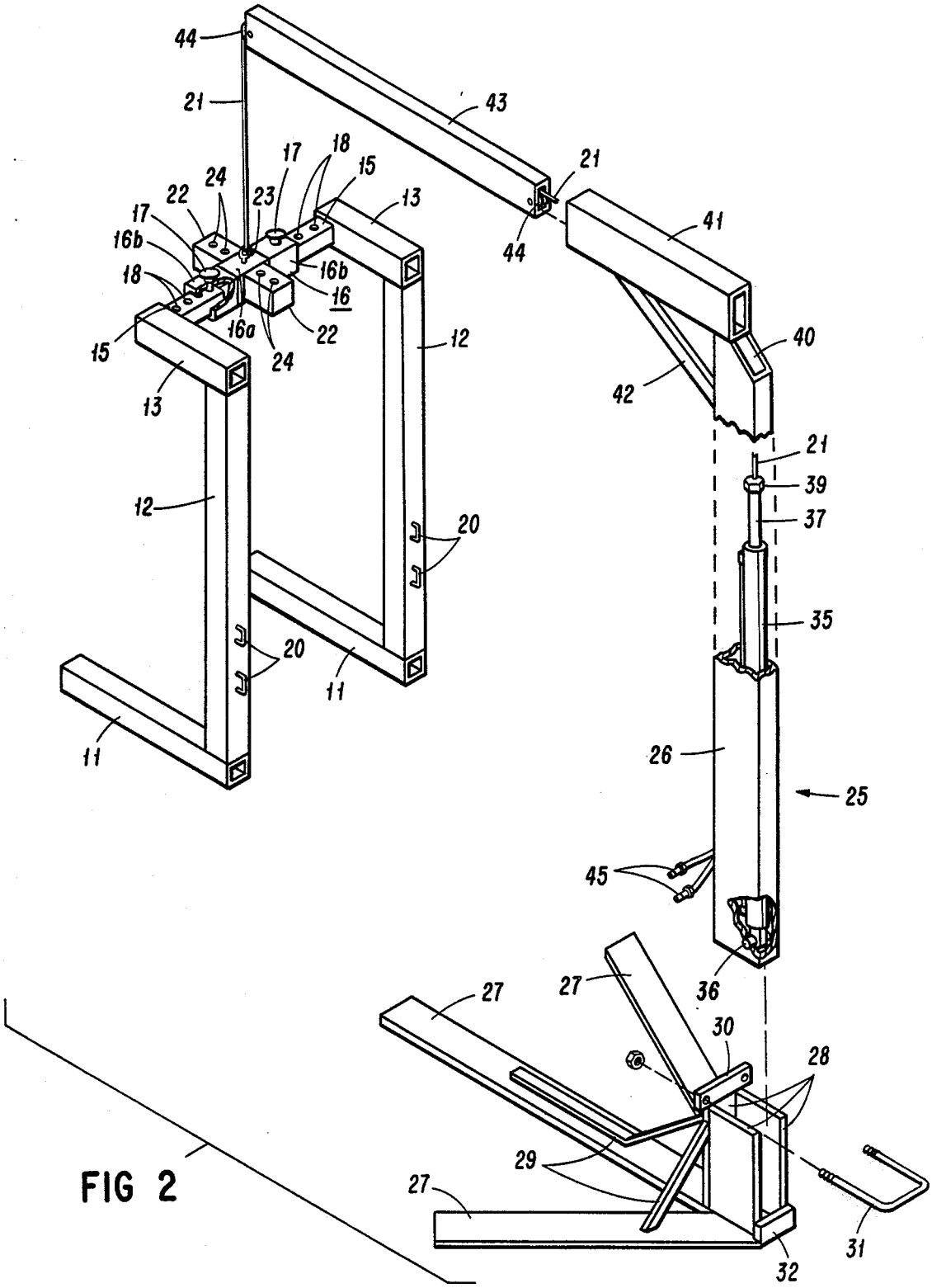
FIG. 2 is a partially exploded, isometric view of the device of FIG. 1.

As shown in FIGS. 1 and 2 the therapeutic device of the invention is constructed largely of square steel tubing and, as noted, includes a cradle 10 composed of a pair of laterally spaced, parallel arm members 11. To the rear ends of the arm members 11 is welded a pair of upright arm brackets 12 with forwardly extending headers 13, the arm members 11, brackets 12 and headers 13 all being covered with padding indicated at 14. Between the headers 13 is welded a pair of short opposed solid legs 15 which are received in turn in the ends of a composite cross-bar 16 consisting of a solid mid-section **16*a* to whose ends are welded a pair of sleeves 16*b* in order to interconnect the arm members 11 as well as to permit the spacing between the latter to be adjusted. Adjustment may be accomplished by a pair of headed pins 17 through the cross-bar sleeves 16*b* and apertures 18 in the legs 15. A pair of adjustable back straps 19 may be included and secured between lugs 20 on the rear of the arm brackets 12**.

The cradle 10 may be mounted and its elevation adjusted in several ways. Preferably it is suspended from a flexible cable 21 attached at its lower end to the cradle cross-bar 16. The cable 21 allows the cradle 10 to move forward and backward as well as to pivot which increases the mobility and comfort of the user. For this purpose the arm brackets 12 must be of sufficient height above the arm members 11 so that the cross-bar 16 is well above the user's head. The attachment of the cable 21 to the cradle 10 should be such that the axis of the cable 21 passes generally through the center of gravity of the user's body so as to maintain as much stability as possible. Since that center of gravity can vary fore-and-aft, depending upon the user's body, the point of attachment of the cable 21 to the cradle 10 is also made adjustable. This may be achieved by welding a pair of short fore-and-aft solid legs 22 to the cross-bar mid-section **16*a* and securing the cable 21 by a bolt 23 through the appropriate one of several apertures 24 through the cross-bar mid-section 16*a* and legs 22**.

The other end of the cable 21 is attached to a supporting standard, generally indicated at 25, comprising an upright hollow column 26 having feet 27 secured to the lower end of a socket 28 fabricated from plate material which is braced at 29 to the feet 27. The lower end of the column 26 slips into the socket 28, the front wall of the latter being provided with an upper cross-plate 30 bored at its ends to receive a U-bolt 31 which embraces the column 26. A stop-plate 32 across the rear lower end of the socket 28 locates the bottom of the column 26. Within the latter is disposed a double acting hydraulic ram 35 pivoted at 36 at its lower end between the side walls of the column 26, its piston rod 37 extending upwards from its piston 38 (see FIG. 3) and having the other end of the cable 21 attached to it at 39. The upper end of the column 26 is open at 40 adjacent the rear end of a sleeve 41 welded thereto and braced at 42. The sleeve 41 receives a hollow beam 43 whose forward and rearward ends are fitted with horizontally journaled sheaves 44 over which the cable 21 is entrained, whereby to suspend the cradle 10.

Elevation of the cradle 10 is adjusted by the hydraulic circuit shown in FIG. 3 incorporating a pump P driven by a motor M, the pump P supplying each side of the piston 38 of the ram 35 through lines 45 in which is interposed a 3-position shuttle valve V1 operated by solenoids S1 and S2, whereby to raise or lower the cradle 10 depending upon the position of the valve V1. If desired the hydraulics can be located in a housing attached to the standard 25. The motor M and solenoids S1 and S2 are electrically connected to a source of power, as shown in FIG. 4, through a pair of single pole, single throw switches SW1 and SW2 which are located in a box 46 handy to a person in the cradle 10. Alternately the switches SW1 and SW2 could be incorporated in the forward end of one of the arm members 11 along with some type of wireless transmitter which would activate the hydraulics through a receiver located there, thus eliminating the need for a cord between the switches SW1 and SW2 on the one hand and the motor M and solenoids S1 and S2 on the other.

Turning now to FIG. 5, a person is shown seated in an armless chair 47 or the like. The width of the cradle 10 is adjusted by the pins 17 so that the arm members 11 closely straddle the person's body, the elbows being back against the brackets 12 so that when the forearms lie on the arm members 11 the upper arms are substantially upright and the back against the straps 19. This is important so that when the cradle 10 is elevated, by closing the switch SW1, the weight of the body will be taken vertically through the upper arms and shoulders. The fore-and-aft location of the cable 21 relative to the cradle 10 should also be adjusted by moving the bolt 23 so that the axis of the cable 21 passes generally through the body's center of gravity. The switch SW1 is held closed just long enough for the ram 35 to lift the weight of the body at least partially off the underlying seat of the chair 47, thus reducing compression on the spinal column. If the seat of the chair 47 is not cushioned it is preferable to include a soft foam cushion 48 on its seat so that the body's weight is not either "all on" or "all off" the chair 47. Closing the switch SW2 in turn will correspondingly lower the person's weight back down on the chair 47.

Though the invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. A therapeutic device comprising a cradle assembly, the cradle assembly including a pair of laterally spaced, generally parallel arm members having forward and rearward ends, arm member supporting means adjacent the rearward ends of the arm members and rigidly connected thereto and to each other the arm member supporting means also rigidly interconnecting the arm members and including means for adjusting said spacing between the arm members, the arm members, said adjusting means comprising sliding joint connections which adjust each of said arm members and their corresponding arm member supporting means in parallel relationship to each other when adjusted being effective to closely straddle the body and to underlie the forearms of a person seated on an underlying surface with the person's elbows adjacent the rearward ends of the arm members and the person's upper arms generally upright; and elevating means for adjusting the height of the cradle assembly relative to said underlying surface effective to exert an upward force upon the seated person's arms sufficient to at least partially lift the weight of the person's body from said underlying surface.

2. The device of claim 1 wherein the cradle assembly elevating means is attached to the arm member supporting means.

3. The device of claim 2 wherein the cradle assembly elevating means includes a cradle assembly suspending member attached at a lower end to the arm member supporting means and at another end to an overhead supporting assembly.

4. The device of claim 3 wherein the arm member supporting means includes a pair of support members secured to an extending upwards from the respective rear ends of the arm members, the upper ends of the support members extending forwardly of the rear ends of the arm members and above the head of the person seated as aforesaid, a cross-member joining the upper ends of the support members, said means for adjusting said spacing between the arm members being incorporated in the cross-member is a flexible cable attached at its lower end to the cross-member, the cross-member including means for adjusting the point of attachment of the cable thereto forwardly and rearwardly relative to the cross-member so that the axis of the cable passes substantially through the center of gravity of a person seated as aforesaid.

5. The device of claim 4 wherein the overhead supporting assembly includes an upright standard, the upper end of the standard having secured thereto one end of a generally horizontal beam, the upper end of the cable engaging the other end of the beam.

6. The device of claim 5 wherein the overhead supporting assembly further includes a double acting hydraulic ram disposed within the standard with its piston rod extending upwardly from its piston, a pair of sheaves journaled about horizontal axes respectively disposed at each end of the beam, the cable being entrained over the sheaves and its other end attached to the piston rod of the ram; and means for selectively varying the quantity of hydraulic fluid on each side of the piston of the ram in order thereby to adjust the height of the cradle assembly above said underlying surface.

* * * * *